United States Patent [19]

Grieco et al.

[11] 3,993,813

[45] Nov. 23, 1976

[54] LIGHT TRANSMITTING WINDOW PANES

[76] Inventors: Gaetano C. R. Grieco, 6506 E. Sunnyside Drive, Scottsdale, Ariz. 85254; Joseph P. O. Grieco, 7748 E. Oak St., Scottsdale, Ariz. 85257; Hugo R. A. Grieco, 2208 E. Missouri, Phoenix, Ariz. 85016

[22] Filed: Sept. 27, 1974

[21] Appl. No.: 510,073

Related U.S. Application Data

[63] Continuation of Ser. No. 315,676, Dec. 15, 1972, abandoned.

[52] U.S. Cl. ..... 428/38; 264/158; 264/162; 264/261; 264/297

[51] Int. Cl.[2] ..... B44F 1/06

[58] Field of Search ..... 264/1, 297, 158, 261, 264/162; 428/38

[56] References Cited

UNITED STATES PATENTS

| | | | |
|---|---|---|---|
| 2,992,956 | 7/1961 | Bazinet | 264/1 X |
| 3,420,925 | 1/1969 | Sharif | 264/102 |
| 3,700,533 | 10/1972 | Schmitz | 264/158 X |

*Primary Examiner*—Robert F. White
*Assistant Examiner*—Thomas P. Pavelko
*Attorney, Agent, or Firm*—Cahill, Sutton & Thomas

[57] ABSTRACT

In order to obviate the necessity for preparing individual panes of stained glass or similar panel-like structures, a mold is filled with chunks of glass or other decorative material with a binder, such as liquid epoxy, filling voids between adjacent pieces. After the precast piece is cured, it is cut into slabs of predetermined thickness and ground and polished to a desired surface finish. The glass, wood, or such other material as may be selected is disposed in the mold in a geometric design, a pictorial inlay, or randomly. By utilizing individual component pieces of a selected design which run the full length of the mold, a plurality of precisely reproduced panels is obtained by the cutting operation.

1 Claim, 9 Drawing Figures

LIGHT TRANSMITTING WINDOW PANES

This application is a continuation application of an application entitled "PROCESS FOR FABRICATING ORNAMENTAL PANES, PANELS AND THE LIKE", filed on Dec. 15,1972 and assigned Ser. No. 315,676, now abandoned.

This invention relates to the decorative arts, and, more particularly, to a process for fabricating ornamental panes such as stained glass or similar panel structures.

The classical process for preparing stained glass windows is laborious and time consuming. Briefly, a preliminary layout of each pane is made utilizing glass which has been cut to a predetermined thickness. The indivudual glass pieces are shaped and trimmed until the fabricator is satisfied with the arrangement of the various pieces. A binder (epoxy compounds are now in common use) is then introduced in the interstices and allowed to cure. A skilled artisan may require a length of time on the order of two days to complete a 4 foot ×4 foot pane after he has formulated a preliminary approach to the task. The resulting pane may be highly artistic, but the time required is formidable, and the resulting pane does not have a great deal of structural rigidity.

Similar panes utilizing wood, marble, or other material in a binder and in random, geometric, or pictorial patterns require substantially the same degree of effort. Thus, those skilled in the art will appreciate the desirability of providing means for making decorative panels comprising a plurality of pieces of a selected material held together by a binder, which panels are of a higher quality, both structurally and aesthetically, than may be achieved utilizing classical methods.

It is therefore a broad object of our invention to provide an improved process for fabricating decorative panes and panels.

It is a more specific object of our invention to provide such a process in which a plurality of panes and panels may be fabricated simultaneously.

A further object of our invention is to provide a process in which the resultant panes or panels are structurally strong and aesthetically pleasing.

In another aspect, it is an object of our invention to provide such a process in which a plurality of identical panes or panels may be fabricated simultaneously.

The subject matter of the invention is particularly pointed out and distinctly claimed in the concluding portion of the specification. The invention, however, both as to organization and method of operation, may best be understood by reference to the following description taken in connection with the accompanying drawing of which:

FIG. 2 is a generalized flow diagram presenting the subject process as it may be utilized to prepare stained glass panes or the like;

Figure 1:
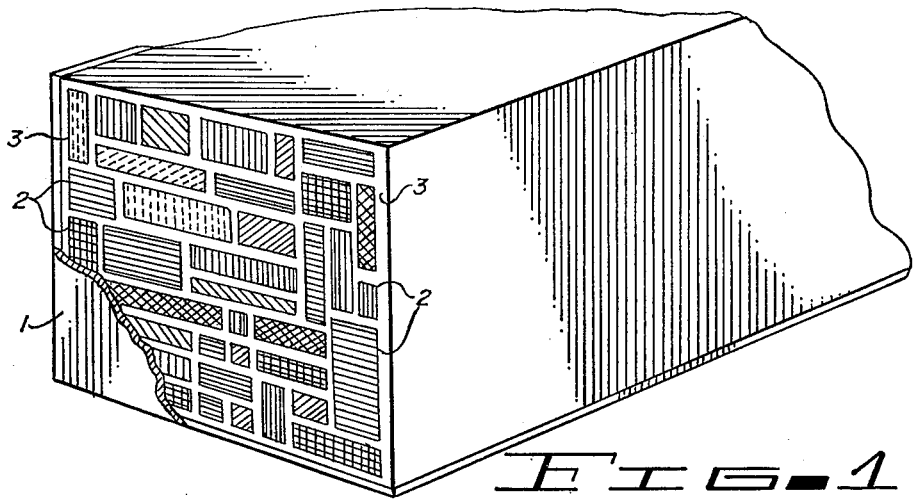
FIG. 1 is a partially cutaway perspective view of a mold containing random pieces of glass representing an intermediate point in the process in the present invention.
Figure 2:
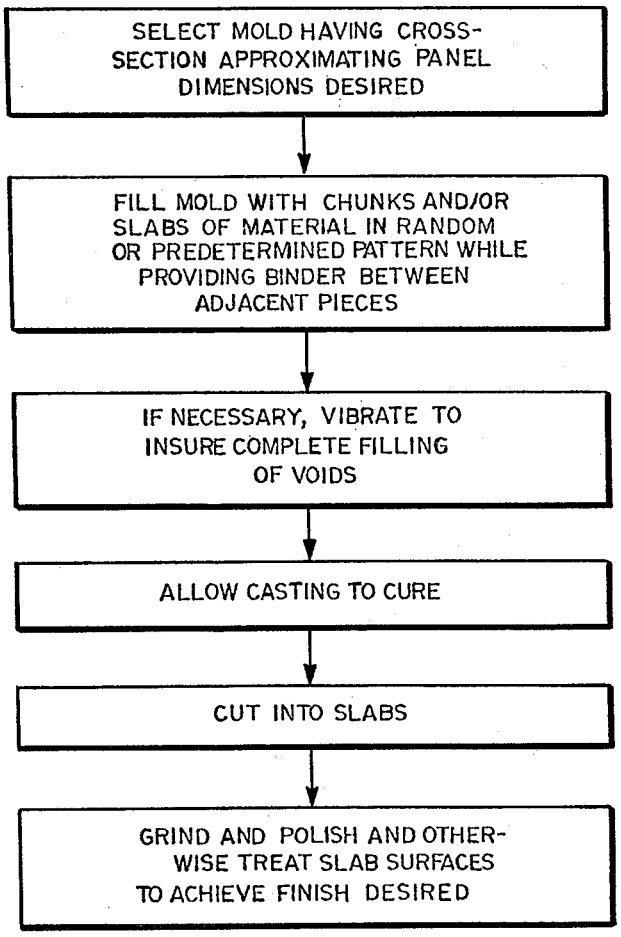
Figure 7:
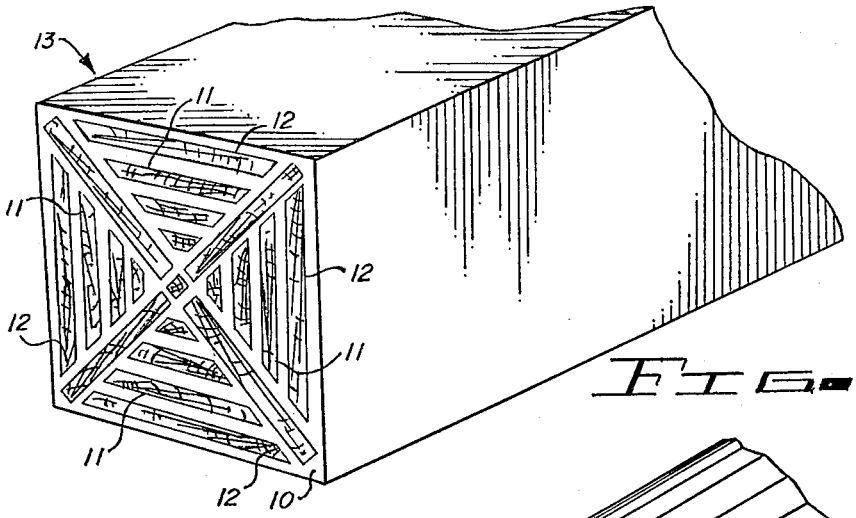
FIG. 7 illustrates the manner in which a preliminary block may be prepared for fabricating inlaid wood panels.
Figure 8:
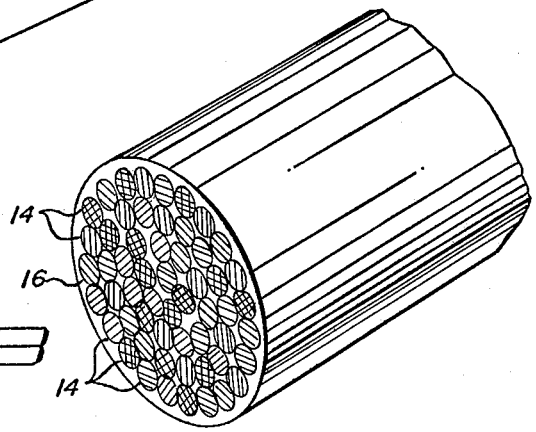
Figure 9:
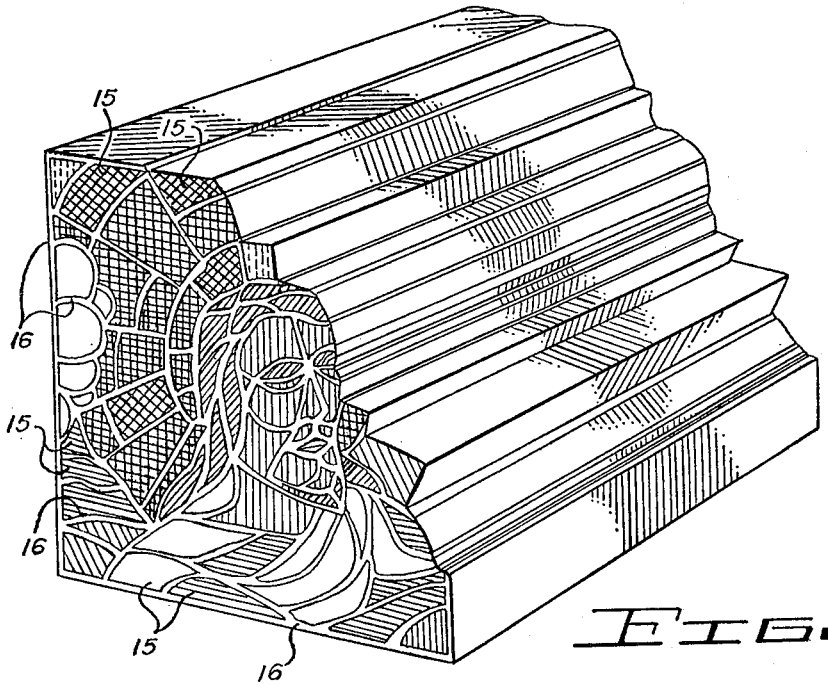

FIG. 8 illustrates the manner in which colored translucent rods may be assembled as an intermediate step in the process; and FIG. 9 illustrates the manner in which panes of a relatively complicated pictorial may be fabricated. , The various configurations of the cast blocks illustrated as completed or partially completed in FIGS. 1, 3, 4, 5, 7, 8, and 9 all represent variant approaches within the subject method presented in FIG. 2 to achieve correspondingly diverse artistic effects. Briefly, the subject process comprehends the preparation of a block having a cross-section approximating the surface area of each face of a finished product. The block comprises chunks and sheets of glass and/or other decorative material and a binder, such as epoxy, which fills voids between adjacent pieces. After the block has cured, it is sawed into a plurality of slabs utilizing a diamond gang saw. Thereafter, the faces of each slab are ground and polished to achieve the surface finish desired to bring out the transparent or translucent characteristics of the panel.

In FIG. 1, the mold 1 is simply a box of sufficient structural rigidity to accommodate the relatively modest outwardly directed pressure exerted before the block has cured. The top of the mold 1 is open to permit piece-by-piece placement of the various glass chunks, slabs, and sheets 2 and methodical placement of layers of a binder, such as liquid epoxy 3, disposed between adjacent glass pieces. The binder in the interstices may be in much thinner layers than may be achieved using classical techniques to provide structural and aesthetic advantages which will become apparent as the description proceeds.

In order to insure that no voids remain in the built-up block, it may be submitted to a vibrating step which compacts the binder and brings any pockets of trapped air to the surface. A vacuum may be applied to achieve the same purpose with or without vibration.

Figure 3:
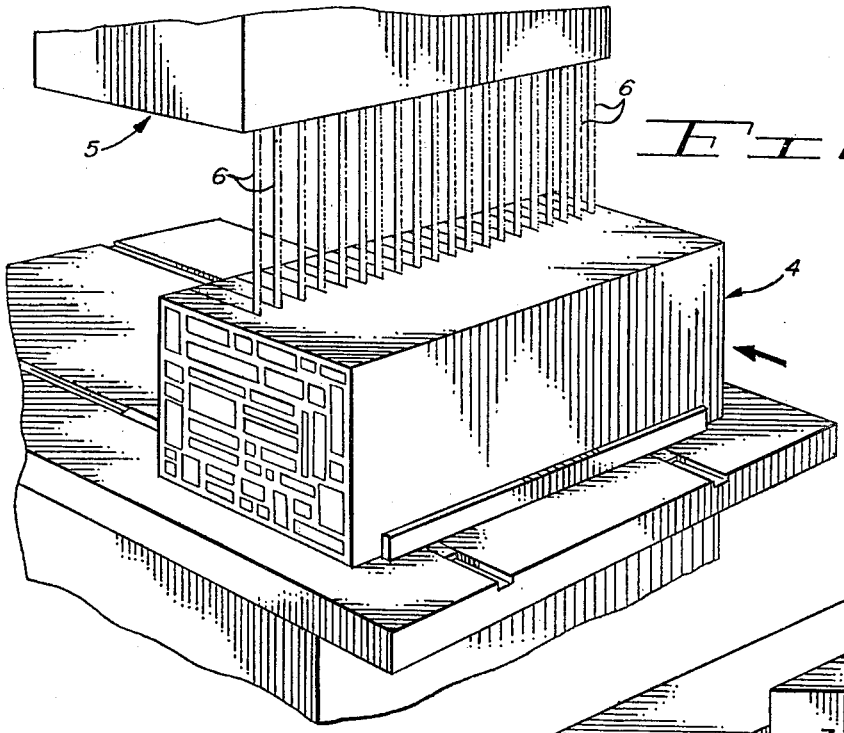
FIG. 3 illustrates a sawing step carried out intermediate within the subject process.

After the binder 3 has cured, the resulting block 4 is placed onto a diamond gang saw 5 as shown in FIG. 3. The blades 6 of the saw, which may be of the type well known in the stone cutting art for cutting granite and other hard rocks, divide the block 4 into a plurality of panels having thicknesses corresponding to the distance between adjacent blades which distance can be adjusted as desired. High grade gang saws are found to leave a surface on the panel faces which requires only a modest amount of subsequent grinding and polishing, utilizing techniques well known in the art, to achieve a fine finish.

Figure 4:
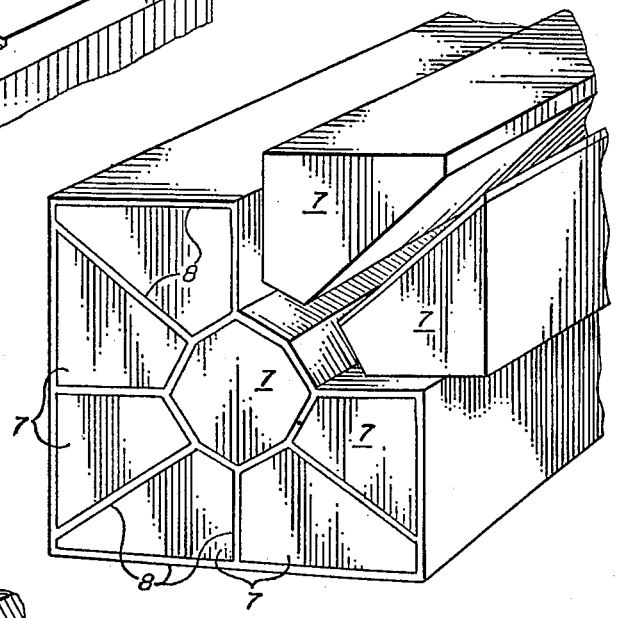
FIG. 4 illustrates the manner in which a geometric pattern may be reproduced in a plurality of identical panes.

When a block is prepared by randomly building it up with odd shapes and sizes of glass chunks and sheets, random stained glass patterns are produced. However, geometric or quasi-random patterns may be achieved by utilizing glass pieces which run the full length of the block. Thus, as shown in FIG. 4, the glass pieces 7, separated by thin layers of binder 8, extend the full length of the block such that each panel resulting from a sawing step as illustrated in FIG. 3 will have a pattern identical to the other panels cut from the block.

Figure 5:
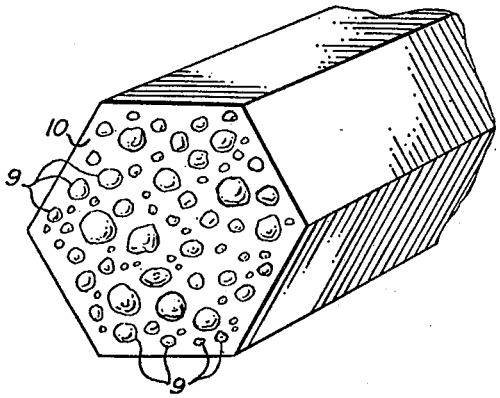
FIG. 5 illustrates an intermediate step in preparing panels with a regular polygon periphery according to the present invention.
Figure 6:
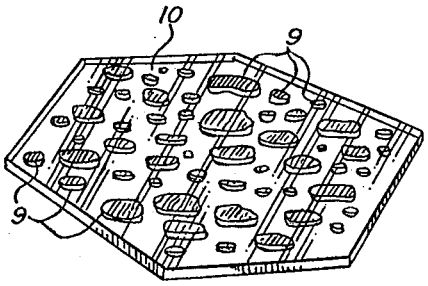
FIG. 6 illustrates a panel in its finished form prepared from the casting of FIG. 5.

Attention is directed to FIGS. 5 and 6 which illustrate a hexogonal casting which may be made by utilizing a suitable vertical mold (not shown) filled with multicolor chunks 9 and a binder 10, such as epoxy. By sawing the casting on a gang saw, a plurality of mosaic panels, such as illustrated in FIG. 6, may be simultaneously produced.

The method of the present invention may also be utilized with such diverse material as wood and plastic. FIG. 7 illustrates the manner in which alternating light wood boards 11 and dark wood boards 12 are methodically stacked together utilizing a binder, such as epoxy, after which the resulting composite block 13 may be sawed into a plurality of panels utilizing the gang saw as previously described and subsequently polishing the surface. This procedure can be used for the production of table tops, doors, wall facings, floor coverings, and the like akin to materials used for production of furniture.

Similarly, as shown in FIG. 8, epoxy may be utilized to bond together translucent plastic rods 14 after which the structure may be sawed into decorative sections. Plastic sheets, odd shaped pieces, or castings may be similarly treated.

One of the most meaningful uses to which the process of the present invention may be directed is in the preparation of a plurality of identical intricate panels. As shown in FIG. 9, the various glass sections 15 run the entire length of the block and are held together by a binder 16, such as epoxy, between adjacent pieces. After the block is assembled and allowed to cure, it is cut into a plurality of identical panels utilizing the gang saw. Each panel so produced would be virtually impossible to achieve by classical methods because of the difficulty experienced in laying out adjacent pieces of the pattern sufficiently close to one another.

Special effects may be achieved by combining a plurality of previously cast blocks, each comprising various chunks of decorative material bound together, into a larger cast block. Intricate and variegated design combinations may be achieved utilizing this technique extension.

If a translucent binder is autilized in conjunction with chunks of opague material, such as wood, marble, etc., a panel prepared in accordance with the method of the instant invention achieves a "spider web" effect which is pleasing and also functional in that light may be admitted through the panel while privacy is maintained.

While the principles of the invention have now been made clear in an illustrative embodiment, there will be immediately obvious to those skilled in the art many modifications of structure, arrangement, proportions, the elements, materials, and components, used in the practice of the invention which are particularly adapted for specific environments and operation requirements without departing from those principles.

We claim:

1. A series of light transmitting window panes having a plurality of non-identical pieces of light transmitting elements and formed from an elongated solid block, each said window pane of said series having a reproduced mosaic design, said window panes being produced by a process comprising the steps of:

a. selecting a mold having cross-sectional dimensions approximating the height and width of said window panes;

b. placing a plurality of non-identical pieces of light transmitting material within the mold;

c. arranging said plurality of pieces to portray a cross-sectional mosaic pattern for said elongated solid block;

d. adding a curable binder intermediate adjacent ones of said plurality of pieces within the mold;

e. said piece arranging and binder adding steps effected on a piece-by-piece basis and methodical placement of a binder thereover to provide a built-up elongated block of material within the mold;

f. compacting the mold to eliminate voids adjacent said plurality of pieces and aid in circumscribingly distributing said binder about said plurality of pieces;

g. curing said binder to bind said plurality of pieces to one another and develop said elongated solid block;

h. cutting said elongated solid block with a plurality of cuts transversely along said elongated solid block to produce a commensurate plurality of slabs with opposed parallel faces, adjacent ones of said slabs having a reproduced mosaic design, each of said slabs defining an unfinished one of said window panes; and i. working the opposed faces of each of said slabs to a predetermined finish; whereby, a reproduced mosaic design exists within said series of said window panes.

* * * * *